US005829954A

United States Patent [19]

Pruett

[11] Patent Number: 5,829,954

[45] Date of Patent: Nov. 3, 1998

[54] ROTARY MOTION FEEDER

[75] Inventor: Daniel W. Pruett, Athens, Ga.

[73] Assignee: Food Machinery Sales, Inc., Athens, Ga.

[21] Appl. No.: 613,905

[22] Filed: Mar. 11, 1996

[51] Int. Cl.[6] ..... B65G 59/06

[52] U.S. Cl. ..... 414/797.9; 414/797.7; 198/598

[58] Field of Search ..... 414/796.1, 797.4, 414/797.7, 797.9, 789.9, 798.9; 198/831, 598

[56] References Cited

U.S. PATENT DOCUMENTS

| | | | |
|---|---|---|---|
| 1,092,706 | 4/1914 | Forry | 414/797.9 |
| 2,543,280 | 2/1951 | Everett | 198/598 |
| 2,576,366 | 11/1951 | Smith | 414/796.1 |
| 2,594,241 | 4/1952 | Williamson | 414/796.1 |
| 2,612,254 | 9/1952 | Carter | 198/598 |
| 2,792,922 | 5/1957 | Malhiot | 414/797.7 |
| 4,013,179 | 3/1977 | Fluck | 414/796.1 |
| 4,311,230 | 1/1982 | Crawford et al. | 198/457 |
| 4,755,093 | 7/1988 | Francioni | 414/797.9 |
| 5,383,761 | 1/1995 | Fluck | 414/797.7 |
| 5,487,461 | 1/1996 | Focke | 414/798.9 |

*Primary Examiner*—Karen M. Young
*Assistant Examiner*—Gregory A. Morse
*Attorney, Agent, or Firm*—Alston & Bird, LLP; Charles H. Fails

[57] ABSTRACT

A rotary motion feeder for use in placing work products into one of the flights of a feed conveyor of a packaging machine is disclosed. The rotary motion feeder includes a planetary feeder assembly supported on a framework, the planetary feeder assembly being moved in timed relationship with the feed conveyor. The planetary feeder assembly includes a plurality of upwardly extending planetary shafts, each planetary shaft having a feed paddle mounted on the end thereof, the feed paddle being constructed and arranged to at least partially extend through a comb plate formed as a part of a feed magazine for stripping work products therefrom, and moving the work products through an arcuate path into one of the flights of the feed conveyor as it moves along the path of travel through the packaging machine. The rotary motion feeder is also constructed and arranged to move horizontally stacked work products into the flights of the feed conveyor.

36 Claims, 6 Drawing Sheets

ROTARY MOTION FEEDER

FIELD OF THE INVENTION

This invention relates in general to packaging machinery. More particularly, this invention relates to a rotary motion feeder used to feed work products into the flights of a feed conveyor in timed relationship with the movement of the feed conveyor along a path of travel through a packaging machine.

BACKGROUND OF THE INVENTION

As the operational line speed of modem packaging machines increases due to improvements in packaging machine technology, improved feed mechanisms adapted for use with these improved packaging machines are required. However, coupled with the need to feed work products at high production rates is the need to handle the work products, particularly food products, gently so as not to damage the work products during packaging operations.

One type of device adapted for use with food products, and in particular horizontal stacks of single crackers or cookies, is a rotary disk feeder which has a rotary feed disk containing several pockets defined therein and into which work products are dropped, the work products being moved therein over a dead plate and dropped downward into a flighted feed conveyor as it passes from underneath the dead plate. Although this type of mechanism has proven its durability and reliability for use with stacks of single work products, this type of machine is not particularly well suited for feeding a previously baked double soda cracker, i e., a soda cracker which has two single crackers joined together along a perforated or scored line baked into the cracker. In a rotary disk feeder the work products are pushed or otherwise moved along their lengths, i.e., their longest dimension, from a feed magazine into the pockets of the rotary disk feeder. However, in double crackers the baking of the cracker occasionally results in the formation of ridges or unevenness in the surface of the cracker so that the crackers may tend to be deflected upward with respect to and on one another as each cracker is stripped lengthwise from a feed magazine or a supply chute, resulting in the cracker breaking along the score line and/or damaging the cracker during the strip out process. Therefore, what is needed is an apparatus which will strip a double cracker out of a feed magazine laterally across its width, as opposed to its length, to thus minimize the likelihood of upward deflection of the cracker as it passes out of its feed magazine toward and into the flights of a feed conveyor.

Another problem that may result from the use of rotary disk feeders arises from the number of times in which the crackers or other work products are handled. For example, the crackers are first stripped from a magazine, they are then dropped into the pockets of the rotary disk feeder and rotated within the disk feeder, whereupon the crackers are stopped. The crackers are then dropped downward into the flights of a moving feed conveyor, the flights being defined by upwardly extending timing or flight pins, whereupon the crackers or work products are then pushed almost instantaneously by a flight pin of the feed conveyor and moved along the path of travel. This sudden starting and stopping of the crackers might result in damage to certain types of crackers or other work products being packaged. Thus, and although the rotary disk feeder has proven its reliability and durability in food handling operations, this type of feeder is not ideally suited for high speed operations in which double crackers, or elongated work products, are to be stripped from a feed magazine and placed into the flights of a moving feed conveyor.

Another type of feeder assembly known in the food processing art is a shuttle feeder which strips crackers or other items of food from a vertical magazine or feed chute, and moves the items in a rapid lateral motion into the path of travel, whereupon the timing or flight pins of the feed conveyor then move the items along the path of travel. However, and like the rotary disk feeder, the shuttle feeder has the drawback of moving the work of product into the path of travel and stopping the work of product, whereupon the flight pins of the feed conveyor instantaneously move and accelerate the work products along the path of travel, again resulting in the possibility of damaging certain types of work products prior to packaging.

Another drawback with the use of a shuttle feeder in high speed packaging operations arises when feeding relatively delicately baked items, for example baked crackers, cookies, and the like, into a feed conveyor moving at a relatively high rate of speed along the path of travel. Although a shuttle feeder pushes the work of product across its width, as opposed to its length, it does so at a very high rate of speed which has the tendency once again work article of product prior to packaging. For example, if the flighted feed conveyor of the packaging machine is moving at a typical processing rate of 450 flights per minute, the shuttle feeder needs to reciprocate and move work products from the feed magazine into the path of travel seven and a half times every second. This results in a violent jarring movement of the work products into the path of travel. Another drawback with using a shuttle feeder in high speed packaging operations is the inherent mechanical vibrations which results from reciprocating a mechanism 450 times a minute or so, requiring that the shuttle feeder, as well as its supporting framework and machinery, be built so as to not only withstand the vibration of the apparatus, but also the constant mechanical pounding of the feeder components as it reciprocates a feed paddle at high rates of speed.

Another type of feed mechanism known in the art is to use a series of conveyor belts which accumulate work products, and then move the work products into the path of travel. An example of this type of apparatus is shown in U.S. Pat. No. 4,311,230, to Crawford et al, issued Jan. 19, 1982. Crawford et al teach an article feeding mechanism which has a series of aligned conveyors which support and supply a single file of work products to an infeed conveyor of a horizontal wrapping machine. Although the converging belt feed systems are known in the art, conveyor belt feed mechanisms have the drawback in that they usually cannot attain the high rates of production speed needed to accurately place work products into the flighted feed conveyor of a horizontal wrapping machine, or other processing machine.

Thus, what is needed but seemingly unavailable in the art, is an improved feed mechanism for handling work products which moves the work products in a gentle but swift motion toward and into the path of travel of a flighted feed conveyor while also attaining high production rates.

SUMMARY OF THE INVENTION

The present invention provides an improved method and apparatus for loading elongate crackers and other relatively fragile work products in closely spaced rapidly moving series on a surface conveyor system for subsequent placement in packages which overcome some of the design deficiencies of the other feed systems known in the art. The mechanism of this invention strips work products out of a feed magazine or a feed chute in a relatively gentle manner at high production rates, while also moving the work products into the feed conveyor at a speed and in a direction substantially equal to the speed and direction of the feed conveyor moving along the path of travel, thus minimizing the chances of damaging the work products prior to packaging.

The improved method of this invention includes feeding work products from a first infeed station positioned adjacent a flighted feed conveyor, the feed conveyor having a spaced series of flights extending along a longitudinal path of travel through a packaging machine, and moving the work products from the infeed station through an arcuate path into the flights of the feed conveyor along the path of travel in timed relationship with the feed conveyor. This method also includes the steps of horizontally stacking a plurality of work products on top of one another at the infeed station, and of moving the stacked plurality of work products together toward and into the path of travel while maintaining the horizontally stacked relationship of the work products.

The improved method of the invention also includes the step of moving work products from a second infeed station positioned along the feed conveyor and adjacent the path of travel through a second arcuate path into the flights of the feed conveyor and along the path of travel in timed relationship with the feed conveyor. With this novel method, work products can be placed into alternating flights of the feed conveyor by the pair of rotary motion feeders, or work products may be placed into the flights of a feed conveyor by the first rotary motion feeder, the second rotary motion feeder placing work products on top of the work products already placed into the flights of the feed conveyor by the first rotary motion feeder, thus doubling the stack size, or horizontal height, of the work products placed on the feed conveyor.

As the work products are moved through either the first or second arcuate path into the flights of the feed conveyor, the work products are moved both laterally toward and along the path of travel so that the work products have a speed and direction substantially the same as the speed and direction of the feed conveyor along the path of travel at the time the work products are placed into the feed conveyor.

The improved rotary motion feeder of this invention includes a frame positioned adjacent the path of travel, a planetary feeder assembly rotatably supported on the frame, and a mechanical drive for rotating the planetary feeder assembly in timed relationship with the movement of the feed conveyor as it moves along the path of travel, In the alternative, the planetary feed conveyor can be powered by an electronic drive, for example, a digitally controlled servo-drive.

The rotary motion feeder assembly of this invention is typically provided at an infeed station positioned with respect to the planetary feeder assembly, the infeed station having a feed magazine for accumulating a plurality of work products, and a comb plate spaced from the feed chute on which work products are supported prior to being moved by the planetary feeder assembly toward and into the path of travel. The comb plate includes a spaced series of elongated and generally horizontal teeth which support the work products thereon, and also acts as a dead plate for supporting the work products as they are moved by the planetary feeder assembly toward and in the direction of the path of travel. The teeth of the comb plate extend in arcuate fashion along at least a portion of the path of travel from the infeed station toward and in the direction of the path of travel.

The planetary feeder assembly includes a horizontal central shaft mounted on the frame, and a generally horizontal carrier assembly supported on the shaft and rotated about the shaft by a mechanical drive. A sun gear is mounted on the central shaft and a plurality of idler gears spaced radially about the central axis are engaged with the sun gear. A plurality of generally horizontal and elongated planetary shafts, each shaft having a planetary gear mounted thereon intermediate its ends and engaged with one each of the idler gears to accomplish the planetary movement of the planetary shafts about the central axis, are also provided. Each of the planetary shafts has an end which extends upwardly away from the carrier assembly, and on which a feed paddle is mounted.

Each feed paddle includes a generally horizontal base plate, a spaced series of aligned and generally horizontal stripping fingers formed along a leading edge of the base plate, and a generally horizontal pusher finger positioned on an edge of a protruding portion of the base plate and spaced with respect to the stripping fingers forming an open pocket for receiving and moving work products toward the path of travel. The aligned stripping fingers are oriented on each feed paddle parallel to the path of travel, and maintain this parallel orientation as each of the feed paddles rotates about the central axis and through the comb plate of the infeed station while moving work products across the teeth of the comb plate onto and over a dead plate adjacent the feed conveyor, and into the path of travel, thus ensuring uniform product handling at high production rates.

Thus, it is an object of this invention to provide an improved rotary motion feeder and a feed method which provide gentle product handling characteristics at high production rates.

Yet another object of this invention is to group work products together at an infeed station and move the work products together as a group into the flights of the feed conveyor.

Still another object of the present invention is to strip work products out of a feed magazine across their narrowest dimension in order to minimize damaging the work products.

An additional object of the invention is to provide a rotary motion feeder adapted for use with differing numbers and types of work products of varying physical dimensions.

It is also an object of the invention to provide a rotary motion feeder and feed method which requires that packaging facilities need only one type of feeder for handling a variety of work products rather than requiring a number of different types of feeders to handle various types of work products.

Another object of the invention is to provide an improved rotary motion feeder and feed method which can handle double crackers without breaking the crackers on the score lines thereof during the packaging of the crackers.

Yet another object of the invention is to provide an improved rotary motion feeder which is simple in design and operation, is inexpensive to construct and use, and is durable and rugged in structure.

Thus, these and other objects, features, and advantages of the invention will become apparent upon reading the specification when taken in conjunction with the accompanying drawings, wherein like characters of reference designate corresponding parts throughout the several views.

DETAILED DESCRIPTION

Figure 1:
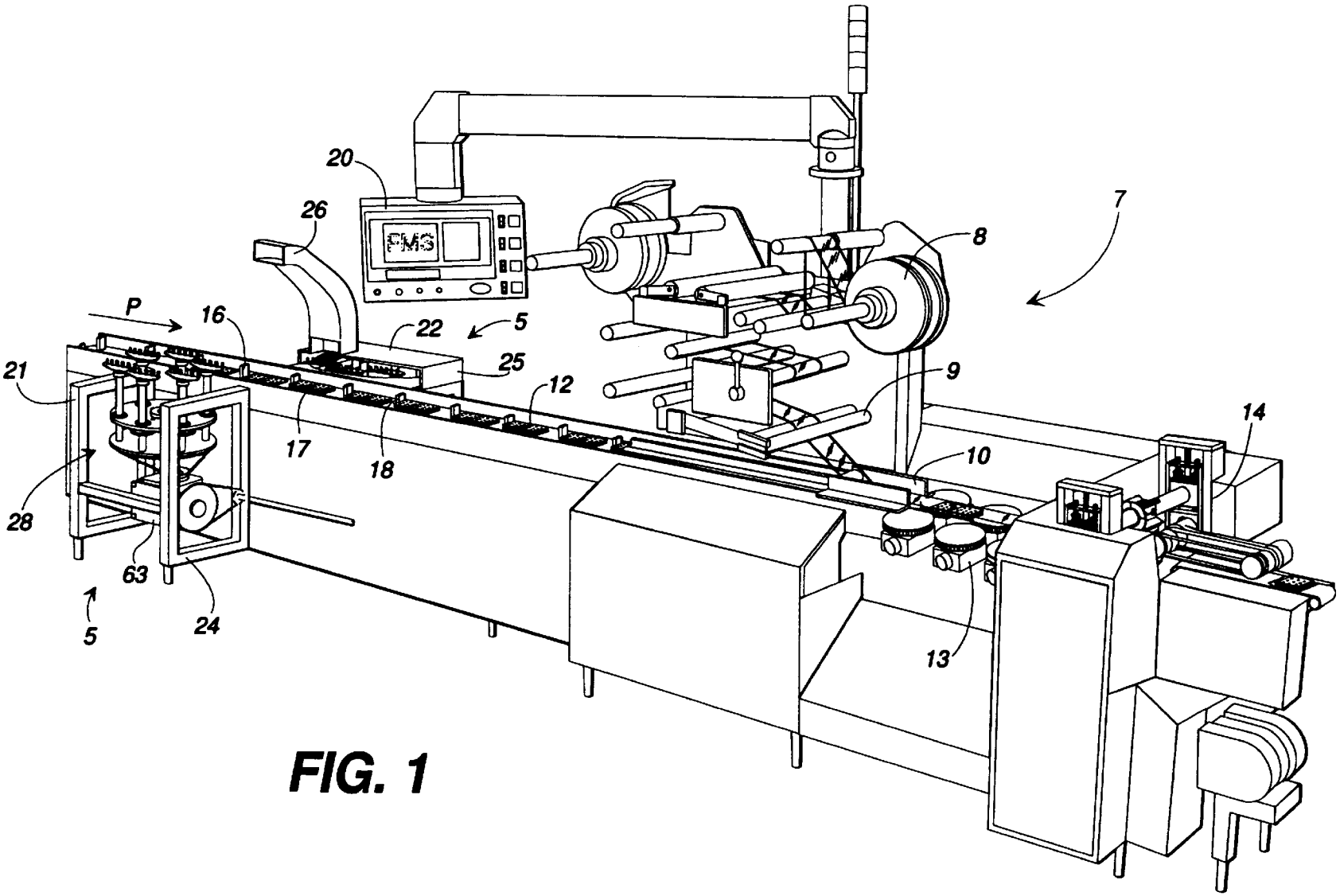
FIG. 1 is a perspective view of a pair of the novel rotary motion feeders of this invention positioned along, and on opposite sides of, a feed conveyor extending along a path of travel through a horizontal wrapping machine.

Referring now in detail to the drawings, in which like reference numerals indicate like parts throughout the several views, numeral 5 of FIG. 1 refers to each one of an identical pair of the novel rotary motion feeders of this invention. As shown in FIG. 1, each rotary motion feeder 5 is used in conjunction with a horizontal wrapping or packaging machine 7 of the type known to those skilled in the art. By way of example, packaging machine 7 may comprise a MACH 3 horizontal wrapping/sealing machine manufactured by Food Machinery Sales, Inc. of Athens, Ga., or other types of horizontal wrappers used for wrapping and sealing work products moved in series through a packaging machine.

Packaging machine 7 is provided with spools of packaging/sealing tape 8 which pass over a series of idler and drive rollers 9 toward a forming shoe 10. Crackers 12, or any similar work of product passed in series along the path of travel P of the packaging machine, are received at forming shoe 10 simultaneously with the packaging tape, whereupon the packaging tape is formed as an enclosed film tube about crackers 12 by fin wheel assembly 13 in known fashion. The fin wheel assembly also acts to pull the packaging tape through the packaging machine. Thereafter, and in fashion known in the art, the tube of enclosed crackers proceeds to a sealing and crimping head assembly 14, whereupon the individual package of crackers is sealed, crimped apart, and moved downstream for further processing and/or packaging.

Packaging machine 7 includes a feed conveyor 16 having a spaced series of flights 17 defined by spaced flight or timing pins 18. Lastly, packaging machine 7 is controlled in known fashion by control processor 20 in which the computer programs are stored which control the packaging machine and the rotary motion feeders 5, where applicable, i.e., should rotary motion feeders 5 be powered by digital servo drives (not illustrated), rather than by a mechanical drive train.

Still referring to FIG. 1, rotary motion feeder 5 is stationed at a first infeed station 21, and at a second infeed station 22, each infeed station being adjacent the path of travel P which extends coaxially with feed conveyor 16 through packaging machine 7. A framework 24 is provided at each of the infeed stations for supporting the rotary motion feeder. As shown generally in FIG. 1 as well as in FIGS. 2, 4, 5A and 5B, rotary motion feeder 5 is generally enclosed within a housing 25 for sealing the rotary motion feeder from the work products being processed for packaging, as well as for safety reasons. A feed magazine 26 extends through housing 25 for providing a generally horizontally stacked series of crackers 12 (FIG. 3), which crackers are stripped from the feed magazine by each rotary motion feeder, and placed into the flights 17 of the feed conveyor as it moves along the path of travel.

Figure 2:
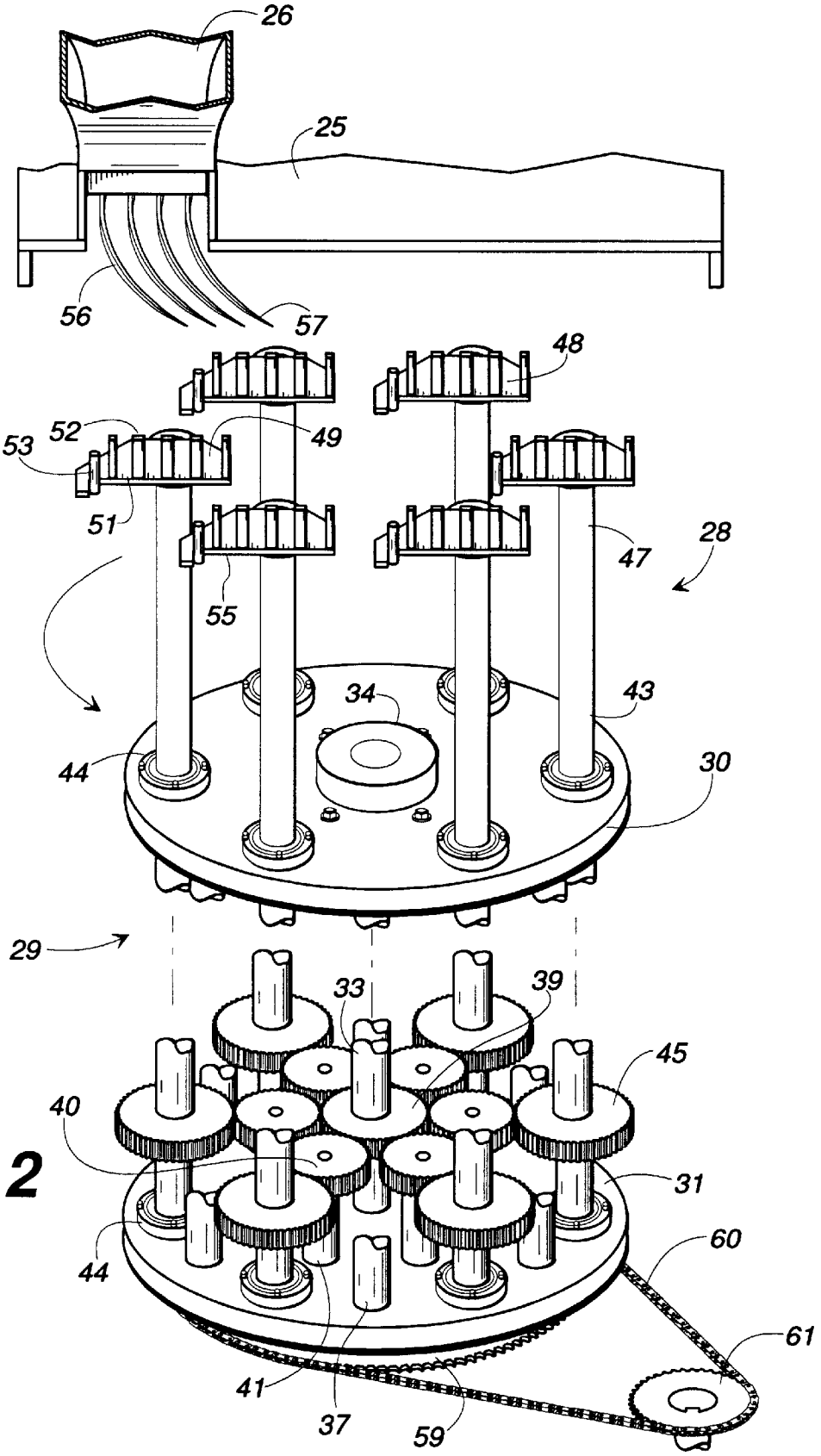
FIG. 2 is a partial exploded perspective view of a preferred embodiment of a rotary motion feeder of this invention.
Figure 3:
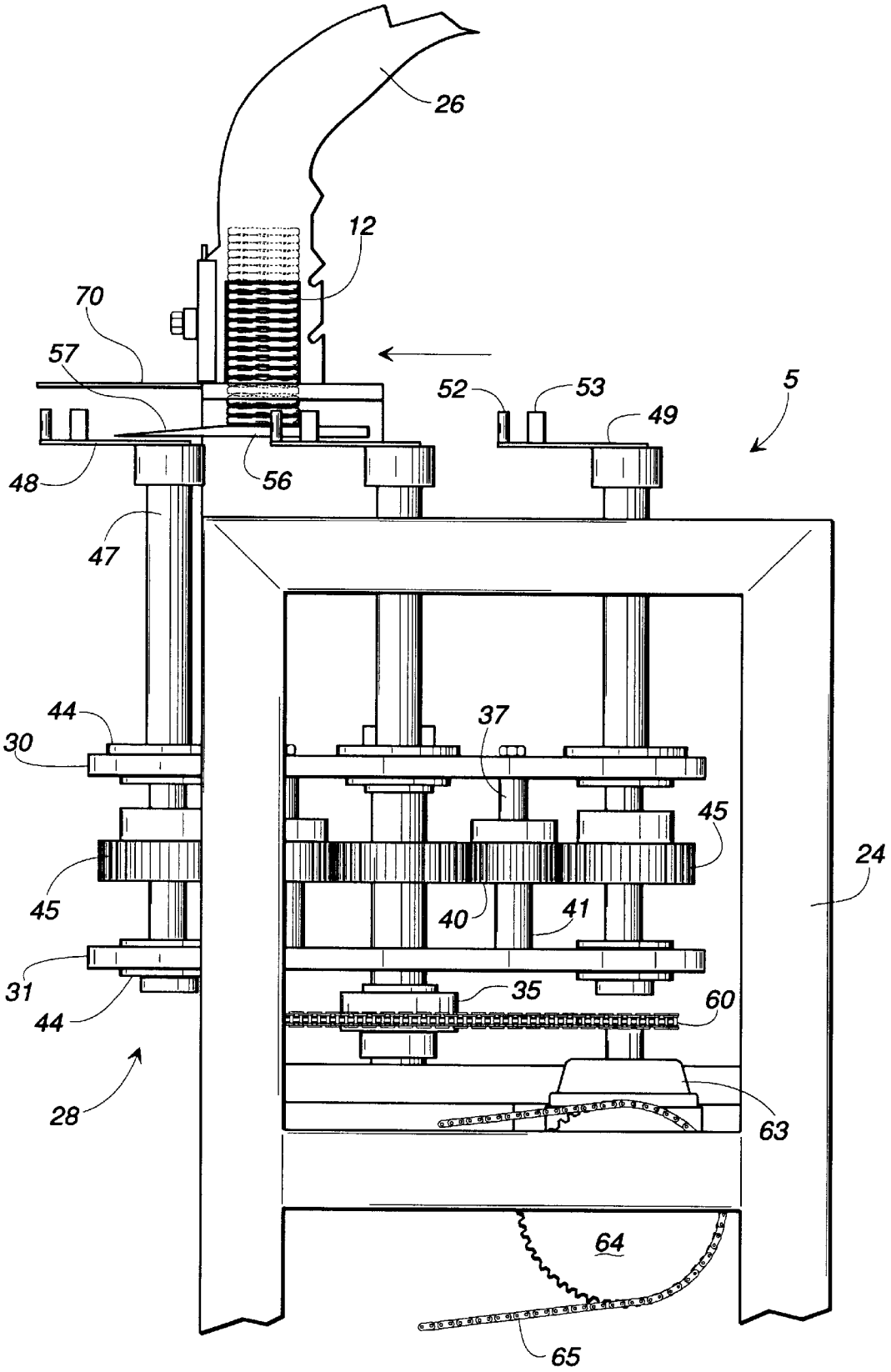
FIG. 3 is a partial side elevational view of a preferred embodiment of the rotary motion feeder.

Each rotary motion feeder 5 includes a planetary feeder assembly 28 shown in greater detail in FIGS. 2 and 3. Referring first to FIG. 2, planetary feeder assembly 28 includes a carrier or carousel 29 comprised of two generally circular discs, a top plate 30 and a bottom plate 31, each of which is supported for rotation on central shaft 33. Central shaft 33 is fixed on framework 24 (FIG. 3) and does not rotate, rather, carrier 29 rotates about central axis 33. Accordingly, the end of central shaft 33 extending through top plate 30 is received within a hub 34 having a bearing (not illustrated) housed therein for rotatably supporting carrier 29 on the central shaft, whereas the opposite end of central shaft 33 extends through bottom plate 31 and is received within a bearing assembly 35 (FIG. 3), again for rotatably supporting carrier 29 on the central shaft. As best shown in FIG. 2, top plate 30 is spaced from bottom plate 31 by a series of spacer shafts 37 which are radially spaced equally apart from one another about central shaft 33.

In known fashion for the construction of planetary gear trains, planetary feeder assembly 28 has a sun gear 39 mounted on central shaft 33. Sun gear 39 does not rotate, rather it is fixed in position on the central shaft. A series of idler gears 40 are supported on idler gear shafts 41, each of idler gears 40 being radially spaced equally apart from one another about central shaft 33, each of idler gears 40 being operably engaged with sun gear 39. Idler gears 40 rotate on idler gear shafts 41, the idler gear shafts being fixed in position on bottom plate 31.

Spaced radially outside of idler gears 40 are planetary shafts 43, each of shafts 43 being spaced equally from one another about the central axis. Each planetary shaft 43 is provided with a bearing 44 in top plate 30 and bottom plate 31, respectively, so that the planetary shaft rotates as the carrier rotates about the central axis. Each planetary shaft 43 includes a planetary gear 45, positioned intermediate top plate 30 and bottom plate 31, operably engaged with one of idler gears 40. Each planetary gear 45 is fixed on planetary shaft 43, planetary shaft 43 rotating as carrier 29 rotates about the central axis. Each planetary shaft has an end 47 which extends upwardly and on which a feed paddle 48 is mounted.

Figure 4:
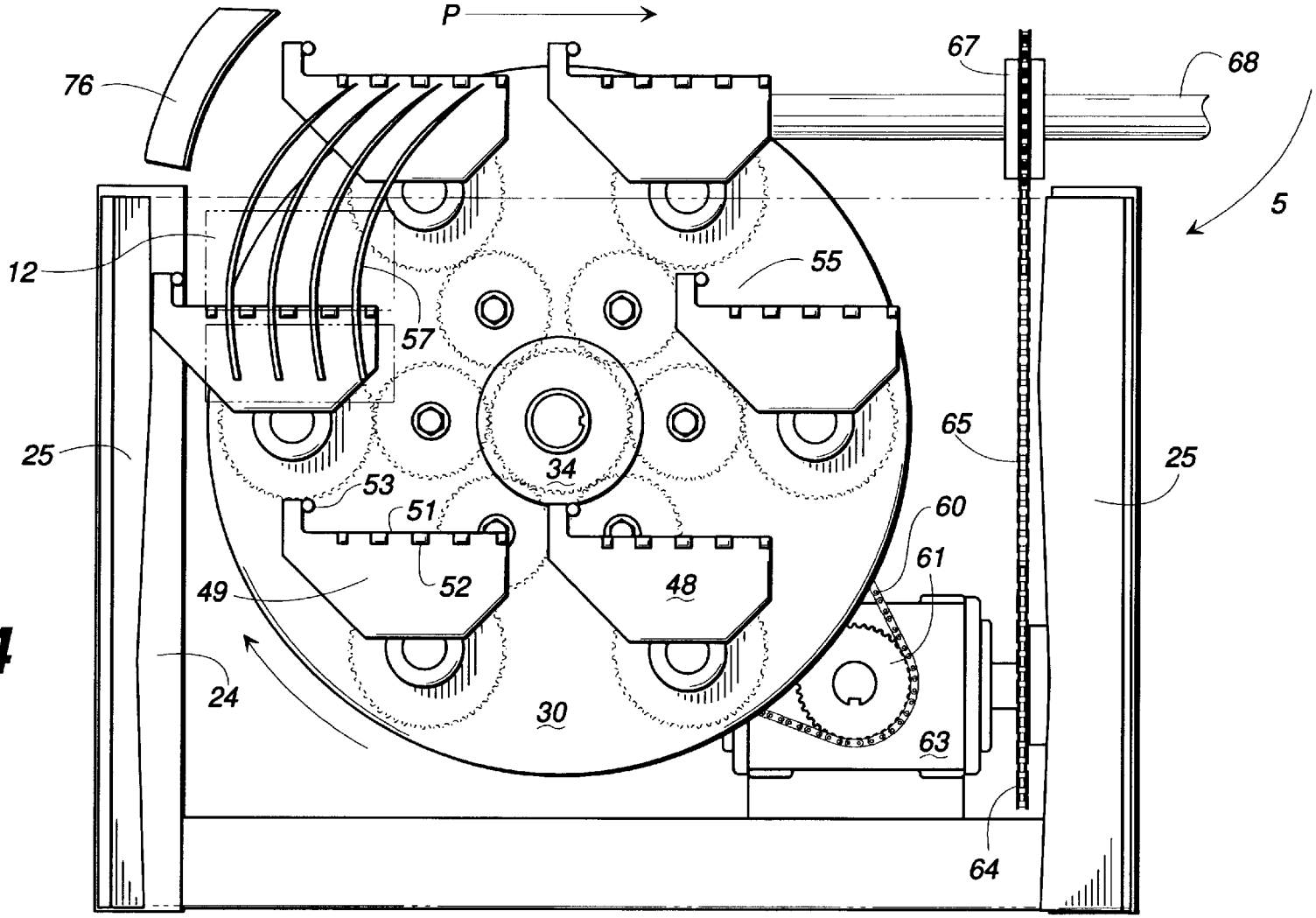
FIG. 4 is a top plan view of the rotary motion feeder.
Figure 5A:
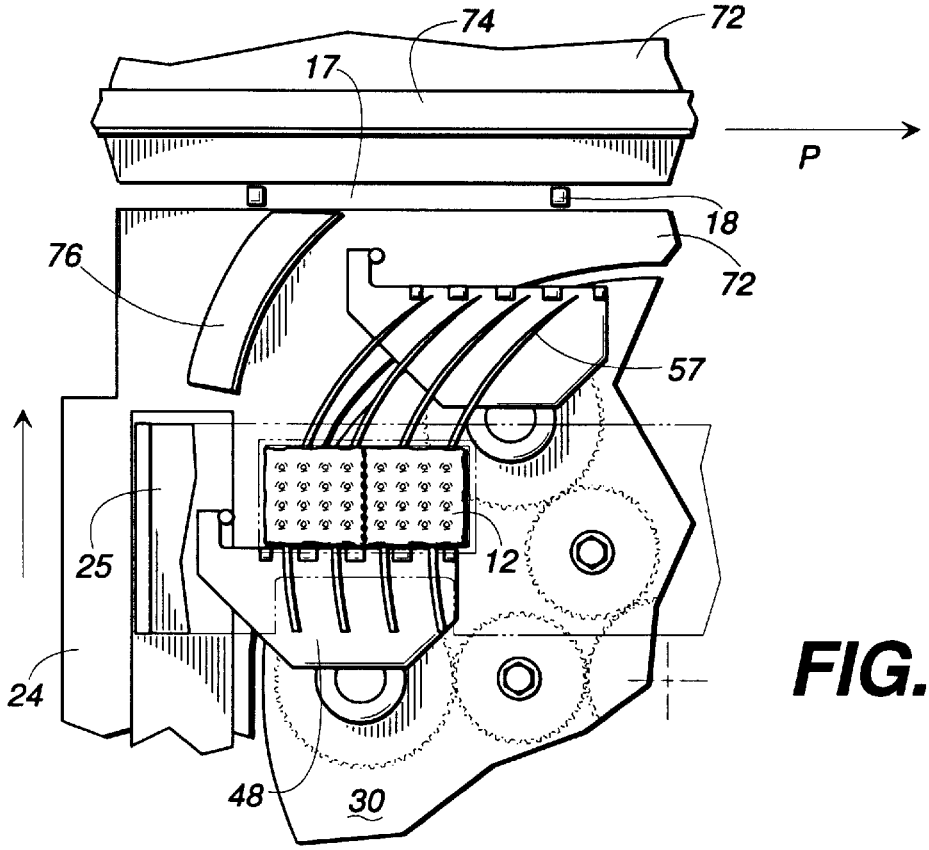
FIG. 5A is a first partial top plan view of a work of product being moved from an infeed station by the rotary motion feeder toward the path of travel.
Figure 5B:
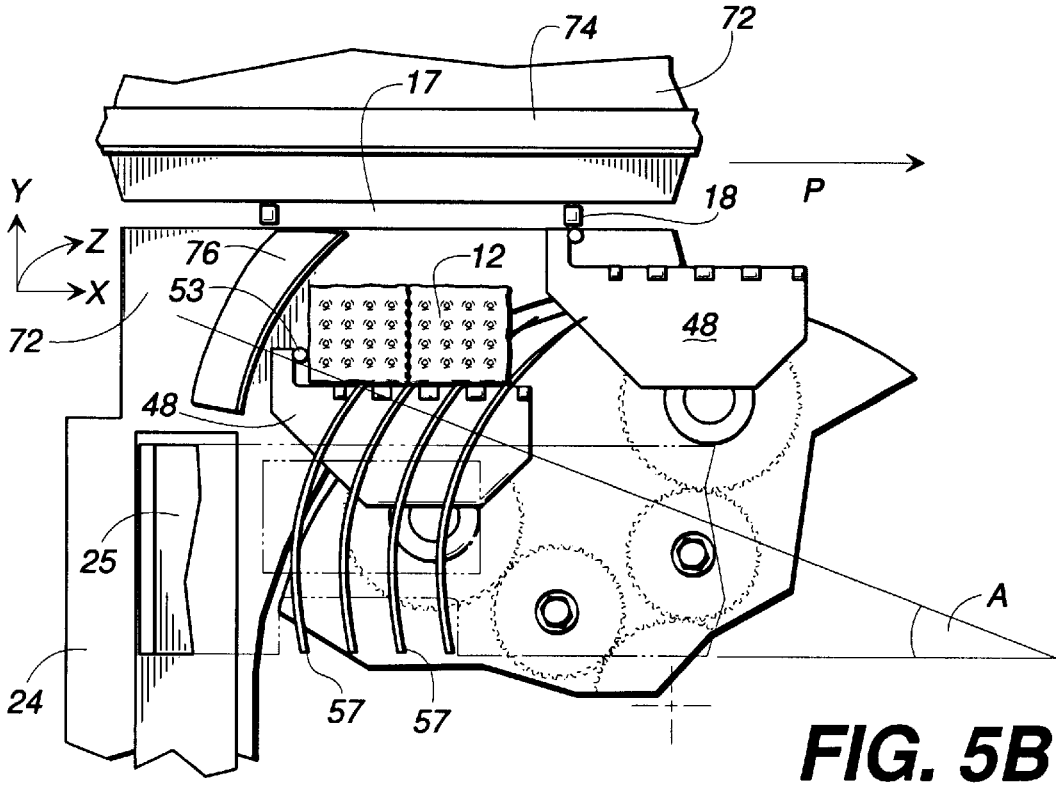
FIG. 5B is a second partial and sequential top plan view of a work of product being moved by the rotary motion feeder toward the path of travel.

As best shown in FIGS. 2 through 4, each feed paddle 48 has a generally horizontal base plate 49 having a leading edge 51 facing in the direction of movement as the planetary feeder assembly rotates about central axis 33. Each feed paddle 48 includes an aligned and spaced series of stripping fingers 52 positioned along leading edge 51 and an offset pusher finger 53 so that the stripping fingers and pusher finger form an open pocket 55 sized and shaped for receiving crackers 12 therein (FIGS. 5A, 5B). As best shown in FIGS. 4, 5A and 5B, the stripping fingers 52 are spaced so that they pass through comb plate 56 provided as a part of each feed magazine 26 (FIG. 3). Each comb plate 56 includes a spaced series of arcuate teeth 57 which extend along an arcuate line in the direction of travel. As crackers or other work products 12 are fed from feed magazine 26 onto comb plate 56, as shown in FIG. 3, and as planetary feeder assembly 28 is rotated about central axis 33 in timed relationship with the movement of feed conveyor 16 along the path of travel, stripper fingers 52 pass between arcuate teeth 57 and strip out crackers 12 across their width (FIG. 3), rather than along their length, thus minimizing the potential damage to the work products as they are stripped out of the feed magazine. Stripping out crackers 12 across their width distributes the stripping force along the length of the crackers, thus cushioning the impact of feed paddle 48 on crackers 12 as they are moved across comb plate 56, passed onto a dead plate 72 (FIGS. 5A, 5B), and then moved over the dead plate into flights 17 of the feed conveyor.

Referring now to FIGS. 1 through 4, planetary feeder assembly 28 includes a drive sprocket 59 (FIG. 2), on which a drive chain 60 is fitted, drive chain 60 being driven by a drive sprocket 61 provided as a part of a right angle gear reducer 63, the right angle gear reducer being best shown in FIGS. 1, 3, and 4. Right angle gear reducer 63 has a second drive sprocket 64 on which drive chain 65 is received, drive chain 65 being driven by a drive sprocket 67 mounted on an elongated drive shaft 68 formed as a part of packaging machine 7 in known fashion. Drive shaft 68 is independently powered by a digital servo motor (not illustrated), or any other type of suitable motor (not illustrated) used to power feed conveyor 16, fin wheel assembly 13, and/or sealing/crimping head assembly 14 so that all components of packaging machine 7 operate in timed relationship with one another.

Accordingly, based upon the ratios of the drive sprockets with respect to one another, planetary feeder assembly 28 can be made to rotate in timed relationship with the movement of feed conveyor 16 along the path of travel so that crackers 12 are placed into flights 17 ahead of timing pins 18 to ensure a positive product placement and movement along the path of travel. The timed relationship of the movement of planetary feed assembly 28 with respect to feed conveyor 16 can be varied by using a mechanical clutch (not illustrated) to change the sprockets, for example, sprockets 64 and/or 67, for increasing or decreasing the speed of planetary feeder assembly 28. It is anticipated that right angle gear reducer will b, fixed at a one-to-one drive ratio, although this also can be varied based upon the production requirements and production rates employed by the operator of packaging machine 7 and rotary motion feeder 5. Lastly, it is also anticipated that planetary feeder assembly 28 could be independently powered by a digital servo drive motor if so desired, operated by control processor 20, using the known digital feedback control techniques employed in the food processing industry.

As illustrated in FIGS. 1 through 4, rotary motion feeder 5 is conventionally constructed. It is anticipated that top plate 30 and bottom plate 31 of carrier 29 will be constructed of stainless steel, or preferably, aluminum. If constructed of aluminum, the top and bottom plates will be powder-coated or otherwise finished so as to protect the plates from the corrosive effects of salt and other ingredients of the crackers 12 or other work products being packaged which are known to create a generally corrosive environment for machinery in food packaging operations. The remainder of planetary feeder assembly 28 will preferably be constructed of conventional carbon-based steel, although it is anticipated that planetary shafts 43 will be constructed of stainless steel, as will feed paddles 48, again for superior corrosion resistance.

Although planetary shafts 43 are shown extending upwardly from carrier 29, it is anticipated that planetary feeder assembly 28 can be constructed in opposite hand so that the carrier is positioned above feed paddles 48, feed paddles 48 being formed at the end of planetary shafts 43 extending downwardly from the carrier in those instances where the planetary feeder assembly would be supported on a framework above the path of travel rather than below the path of travel, as shown generally in FIG. 1.

OPERATION

The operation of rotary motion feeder 5 is shown in greater detail in FIGS. 5A through 6B. FIGS. 5A and 5B are partial top plan views of rotary motion feeder 5 and comb plate 56, with housing 25 cut away, and feed magazine 26 omitted for clarity.

As shown in FIG. 5A, a cracker 12 has been dropped onto the arcuate teeth 57 of comb plate 56 from feed magazine 26 (not illustrated), and stripping fingers 52 of feed paddle 40 are being passed between the arcuate teeth 57 of the comb plate to move cracker 12 over the comb plate toward the path of travel P. The manner in which cracker 12 is stripped from feed magazine 26 is illustrated in FIG. 3, where it is shown that a two-high stack of crackers is resting on comb plate 56, stripping fingers 52 just engaging the side edge of the crackers, whereupon the feed paddle will continue its movement along an arcuate path, shown generally in FIGS. 6A and 6B, for moving the crackers over the comb plate and toward the path of travel. A keeper bar 70 is provided as a part of feed magazine 26 for ensuring that only the desired number of crackers, or other work products, are allowed to be stripped from the feeder magazine by feed paddle 48.

In order to increase or decrease the number of stacked crackers 12 on comb plate 56, comb plate 56 is moved horizontally up or down with respect to feed magazine 26 on housing 24. It is anticipated that crackers 12 will generally be provided as a stacked series of crackers having two, three or four stacked soda crackers 12 therein.

Referring again to FIG. 5A, feed paddle 48 is moving cracker 12 laterally toward the path of travel of feed conveyor 16, and pusher finger 53 has not yet engaged the end of cracker 12 for moving cracker 12 in the direction of the path of travel. However, as shown in FIG. 5B, once feed paddle 48 is moved through an arc of approximately 30°, indicated by the notation "A" in FIG. 5B, pusher finger 53 is moved in the direction of the path of travel and is received against the end of cracker 12, and begins to accelerate cracker 12 in the direction of the path of travel so that cracker 12 is placed at speed into flight 17 ahead of timing pin 18, timing pin 18 then overtaking cracker 12 as feed paddle 48 is withdrawn. This is shown by the vectors X,Y, & Z to the left of FIG. 5B, in which X represents the speed of feed conveyor 16 along the path of travel, Y represents the lateral speed of feed paddle 48, and thus cracker 12, toward the path of travel, and Z represents the acceleration of cracker 12 as cracker 12 is placed into one of flights 17 at a speed and in a direction substantially equal to the speed and direction of feed conveyor 16, whereupon cracker 12 continues to move along the path of travel in a generally continuous motion without the sudden starting and stopping motion of prior art feed devices.

As shown in FIG. 5A, cracker 12 is moved over a comb plate 56 toward dead plate 72 having an edge guide 74 positioned thereon which is parallel to and extends along the path of travel spaced from timing pins 18 of feed conveyor 16, and an arcuate guide 76 is provided for guiding cracker 12 toward the path of travel should it somehow seek to move off of comb plate 56 prior to being passed therefrom by feed paddle 48. As shown in FIG. 5B, then, cracker 12 is being moved off of comb plate 56 onto dead plate 72, whereupon feed paddle 48 will push cracker 12 across dead plate 72 until it is stopped by edge guide 74, edge guide 74 being spaced from timing pins 18 so that cracker 12 will not be crushed between the edge guide and stripping fingers 53 of feed paddle 48.

An additional and unique feature of rotary motion feeder 5 is illustrated in FIGS. 5A and 5B, in which each feed paddle 48 has an orientation along its leading edge 51 parallel to the path of travel, which parallel orientation is maintained as each feed paddle 48 rotates about central shaft 33. Thus, stacked crackers 12, or other work products, can be quickly and efficiently moved toward and into the path of travel without having to worry about the misalignment or mis-orientation of the stacked crackers as they are placed into the flights of the feed conveyor. Moreover, the fact that there are six feed paddles 48 allows for relatively lower strip out rates due to the increased number of feed paddles used, rather than relying upon an extremely rapid strip out process that would be practiced with a reciprocating feeder of the type known in the art. Moreover, due to its construction, rotary motion feeder 5 handles product more gently than would a rotary disc feeder, for example, in that the product is not stripped along its length, rather it is stripped across its width. Thus, this rotary motion feeder offers the unique advantage of having a high production rate coupled with gentle product handling not heretofore obtained by the known feeding devices in the art.

Figure 6A:
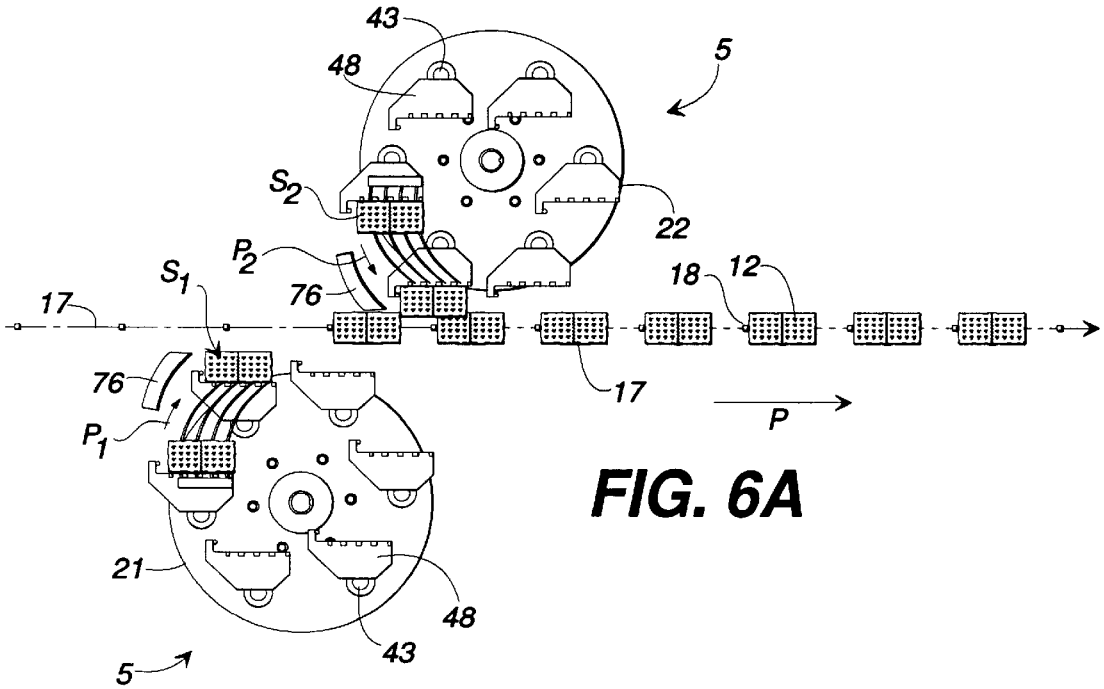
FIG. 6A is a schematic illustration of a first method of feeding work products onto a feed conveyor using the rotary motion feeders of FIG. 1.
Figure 6B:
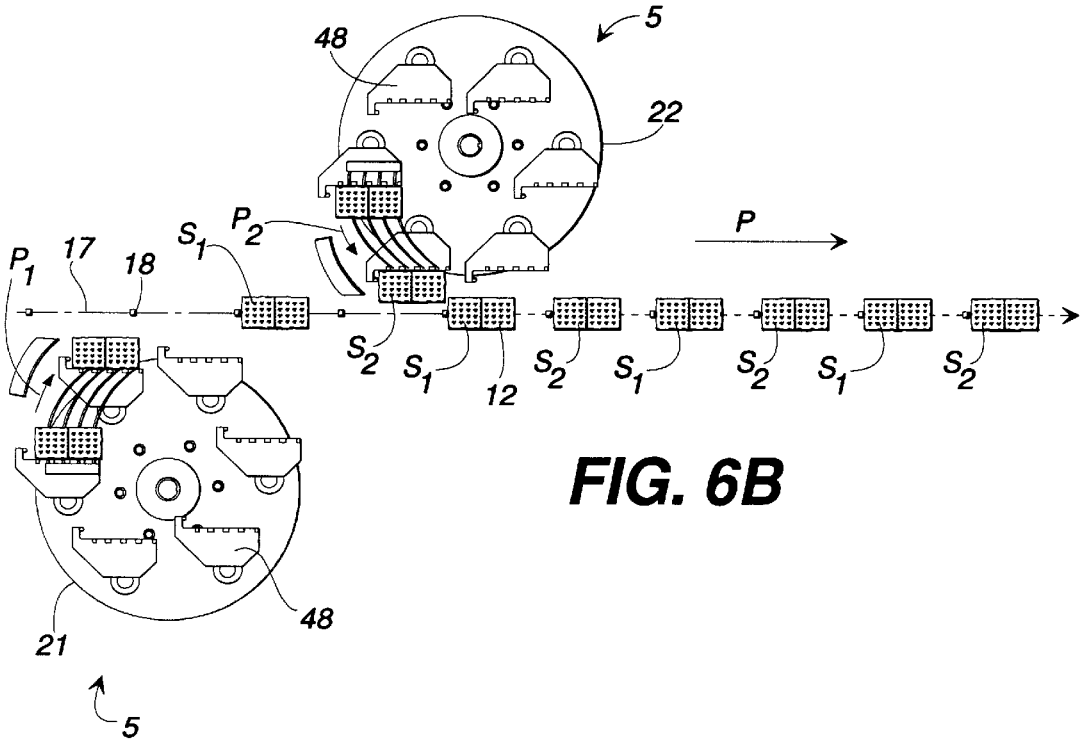
FIG. 6B is a schematic illustration of a second method of feeding work products onto a feed conveyor using the rotary motion feeders of FIG. 1.

Another unique feature of rotary motion feeder 5 is shown in FIGS. 6A and 6B. In FIG. 6A, a first horizontal stack of crackers $S_2$ is moved through a first arcuate path $P_1$ and placed into each flight 17 of feed conveyor 16 by planetary feeder assembly 28 of the rotary motion feeder at first infeed station 21. Positioned downstream along the path of travel is a second rotary motion feeder 5, as also illustrated generally in FIG. 1, in which a second horizontal stack $S_2$ of crackers is moved by planetary feeder assembly 28 through a second arcuate path $P_2$ toward and into each flight 17 of the feed conveyor, thus doubling the stack size or height of the work products within each flight prior to the packaging thereof within the packaging/sealing tape of the machine. Again, and as discussed above, stacks $S_1$ and $S_2$ of crackers can be four-high, six-high, or eight-high, based on the strip out of a stack of two, three or four crackers from feed magazine 26.

If it is desired, however, to package stacks $S_1$ and $S_2$ of crackers which are only two-high, then a first stack $S_2$ of crackers can be placed into every other flight of feed conveyor 16 by rotary motion feeder 5 at first infeed station 21, whereas a second stack $S_2$ of crackers can be placed into the remaining open and alternating flights 17 of feed conveyor 16 by rotary motion feeder 5 at second infeed station 22. Thus, based upon the production needs of the packaging operators using rotary motion feeder 5 and packaging machine 7, the invention disclosed herein offers flexibility in packaging operations previously unavailable in the art, which, when combined with the unique product handling ability and high production rates or rotary motion feeder 5, represents a distinct and novel advance in the art.

When using two rotary motion feeders 5, as shown generally in FIG. 1, and in FIGS. 6A and 6B, a second dead plate (not illustrated) will extend above and up to edge guide 74 so that crackers 12 will be moved over the comb plate 56 of the second rotary motion feeder, and dropped downward into flight 17 of feed conveyor 16 as it moves along the path of travel. As discussed in greater detail above, it is anticipated that the crackers 12 being moved from the second rotary shuttle feeder positioned at second infeed station 22 can be dropped onto crackers 12 already within flights 17 of the feed conveyor, the crackers having been placed there by rotary motion feeder 5 at first infeed station 21.

Although rotary motion feeder 5 has been shown in use with food products, and in particular crackers 12, it is anticipated that rotary motion feeder 5 can be used within any work of product suited for packaging with a horizontal packing machine 7 as described hereinabove. This could include, for example, computer floppy discs, compact discs, video tapes, or any other generally rectangular or elongated work products which can be received within open pocket 55 of feed paddle 48, stripped out of a feed magazine, and moved toward and into the flights of a feed conveyor.

While a preferred embodiment of the invention has been disclosed in the foregoing specification, it is understood by those skilled in the art that variations and modifications thereof can be made without departing from the spirit and scope of the invention, as set forth in the following claims. In addition, the corresponding structures, materials, acts, and equivalents of all means and/or step-plus-function elements in the claimed elements are intended to include any structure, material, or acts for performing the functions in combination with other claimed elements as specifically claimed.

I claim:

1. A method of feeding work products from a first infeed station into a feed conveyor, the feed conveyor having a series of spaced flights defined by a plurality of spaced timing pins moving along a longitudinal path of travel toward a packaging machine, said method comprising the steps of:

moving the work products from the first infeed station through a first substantially horizontal arcuate path ahead of a respective one of the timing pins and into one of the flights of the feed conveyor moving along the path of travel; and delivering the work products to the flight of the feed conveyor in timed relationship with the movement of the feed conveyor at a speed and direction substantially the same as the speed and direction of the feed conveyor along the path of travel.

2. The method of claim 1, comprising the steps of horizontally stacking a plurality of work products on top of one another at the first infeed station, and of moving a first stacked plurality of work products from said first infeed station through said first arcuate path.

3. The method of claim 2, comprising the steps of providing a second infeed station, horizontally stacking a plurality of work products on top of one another at the second infeed station, and of moving a second stacked plurality of work products from the second infeed station through a second arcuate path toward the feed conveyor and directing said second stacked plurality of work products into one of the flights of the feed conveyor.

4. The method of claim 3, further comprising the step of moving said first and said second stacked pluralities of work products, respectively, into alternating flights of the feed conveyor with respect to each other for forming a spaced series of first and second stacked pluralities of work products in alternating flights of the feed conveyor.

5. The method of claim 3, further comprising the step of moving said second stacked plurality of work products on top of the first stacked plurality of work products in timed relationship with the movement of the first stacked plurality of work products along the path of travel.

6. The method of claim 3, comprising the step of increasing or decreasing the number of work products stacked on top of one another in said second stacked plurality of work products.

7. The method of claim 2, comprising the step of increasing or decreasing the number of work products stacked on top of one another in said first stacked plurality of work products.

8. The method of claim 1, comprising the steps of providing a feed magazine at the first infeed station, providing a comb plate at the first infeed station spaced from the feed magazine, constructing and arranging the comb plate to receive work products from the feed magazine thereon, and further comprising the steps of passing a feed paddle through the comb plate, the feed paddle urging at least one of the work products along the comb plate and toward the path of travel.

9. The method of claim 8, comprising the steps of passing said at least one work product from said comb plate onto a dead plate positioned adjacent the path of travel, and of sliding said at least one work product over the dead plate and into the path of travel with said feed paddle.

10. The method of claim 1, each of the work products having a length, comprising the additional steps of positioning each of the work products at the first infeed station so that each of the work products has an orientation along its length parallel to the path of travel, and maintaining said parallel orientation to the path of travel as each of the work products is moved through said first arcuate path into the flights of the feed conveyor.

11. The method of claim 10, wherein said method includes the steps of providing a second infeed station adjacent the path of travel, positioning each of the work products at the second infeed station so that each of the work products has an orientation along its length parallel to the path of travel, moving the work products from the second infeed station through a second arcuate path toward the path of travel into the flights of the feed conveyor and on top of the work products placed in the flights of the feed conveyor from the first infeed station, and maintaining said parallel orientation as the work products from the second infeed station are moved through said second arcuate path and into the flights of the feed conveyor.

12. A method of feeding generally elongate work products from a first infeed station into a feed conveyor having a spaced series of flights extending and moving along a longitudinal path of travel toward a packaging machine, said method comprising the steps of:

a) arranging a first predetermined number of the work products in a horizontally stacked relationship atop one another in a first stack of work products at the first infeed station and adjacent the path of travel;

b) sweeping the first stack of work products laterally away from the first infeed station through a first arcuate path while maintaining the stacked relationship of the work products within the first stack of work products;

c) delivering the first stack of work products to one of the flights of the feed conveyor in timed relationship with the movement of the feed conveyor at a speed and direction substantially the same as the speed and direction of the feed conveyor along the path of travel; and d) orienting each of the work products within said first stack of work products so that the length of each work product in the first stack of work products extends along the path of travel as the first stack of work products is delivered to the feed conveyor.

13. The method of claim 12, comprising the steps of:

a) arranging a second predetermined number of the work products in a horizontally stacked relationship atop one another into a second stack of work products at a second infeed station adjacent the path of travel;

b) sweeping the second stack of work products laterally from the second infeed station through a second arcuate path while maintaining the stacked relationship of the work products;

c) delivering the second stack of work products to one of the flights of the feed conveyor in timed relationship with the movement of the feed conveyor at a speed and direction substantially the same as the speed and direction of the feed conveyor along the path of travel; and d) orienting each of the work products within the second stack of work products so that the length of each work product in the second stack of work products extends along the path of travel as the second stack of work products is delivered to the feed conveyor.

14. The method of claim 13, further comprising the step of placing the second stack of work products on top of the first stack of work products in timed relationship with the movement of the first stack of work products along the path of travel.

15. The method of claim 13, further comprising the steps of moving the first stack of work products and of moving the second stack of work products into alternating flights of the feed conveyor for forming a series of alternating first and second stacks of work products in the flights of the feed conveyor.

16. The method of claim 13, comprising the steps of:

providing a feed magazine at the first infeed station and providing a feed magazine at the second infeed station;

providing a comb plate for the feed magazine at the first infeed station and providing a comb plate for the feed magazine at the second infeed station;

spacing the comb plate from the feed magazine at each infeed station, respectively;

constructing and arranging each comb plate, respectively, to receive work products from said feed magazines thereon; and separately passing a feed paddle through each said comb plate, respectively, said feed paddle urging at least one of the work products along each said comb plate, respectively, and toward the path of travel.

17. The method of claim 16, comprising the steps of:

passing said at least one of the work products from each said comb plate onto a dead plate positioned adjacent the path of travel; and sliding each of said at least one of the work products over the dead plate and into the path of travel with said feed paddle.

18. A rotary motion feeder for feeding work products to a packaging machine, the packaging machine having a longitudinal path of travel extending through the packaging machine, a dead plate positioned along the path of travel, a feed conveyor moving along the path of travel, the feed conveyor having a spaced series of flights formed by a plurality of timing pins extending upwardly through the dead plate, and an infeed station positioned adjacent the path of travel, the infeed station having a feed magazine for holding accumulated work products therein and a comb plate spaced from the feed chute for supporting the work products thereon, the comb plate having a spaced series of elongate and generally horizontal teeth, said rotary motion feeder comprising:

a planetary feeder assembly positioned at the infeed station, said feeder assembly being constructed and arranged to move the work products from the infeed station through an arcuate path and into one of the flights of the feed conveyor in timed relationship with the movement of the feed conveyor at a speed and direction substantially the same as the speed and direction of the feed conveyor along the path of travel; and means for driving said feeder assembly in timed relationship with the movement of the feed conveyor.

19. The rotary motion feeder of claim 18, wherein said planetary feeder assembly comprises:

an elongate central shaft on which said planetary feeder assembly is supported for rotation and about which said planetary feeder assembly is rotated by said means for driving;

a plurality of generally vertical and elongate planetary shafts, each said planetary shaft being parallel to said central shaft; and a feed paddle mounted on an upwardly inclined end of each said planetary shaft, each said feed paddle being constructed and arranged to pass between the spaced teeth of the comb plate.

20. The rotary motion feeder of claim 19, each said feed paddle comprising a base plate, a spaced series of aligned and upwardly inclined stripping fingers formed along a leading edge of said base plate, and an offset pusher finger spaced with respect to said stripping fingers, said stripping fingers and said pusher finger forming a generally open pocket sized and shaped to engage at least a portion of the periphery of the work products.

21. The rotary motion feeder of claim 20, said base plate being cantilevered with respect to said planetary shaft.

22. The rotary motion feeder of claim 20, wherein said stripping fingers of said feed paddle are aligned along said leading edge thereof parallel to the path of travel and remain parallel to the path of travel as said planetary feeder assembly rotates about said central shaft.

23. A rotary motion feeder for feeding work products into a feed conveyor of a packaging machine, the feed conveyor moving along a longitudinal path of travel through the wrapping machine and having a spaced series of flights extending through a dead plate adjacent the feed conveyor, said rotary motion feeder comprising:

a first infeed station adjacent the path of travel, said first infeed station including a first feed magazine for holding accumulated work products therein and a first comb plate spaced therefrom for supporting work products thereon; and a first means for moving a first predetermined number of work products from said first infeed station through a first arcuate path and into one of the flights of the feed conveyor and along the path of travel in timed relationship with the movement of the feed conveyor at a speed and direction substantially the same as the speed and direction of the feed conveyor along the path of travel.

24. The rotary motion feeder of claim 23, further comprising:

a second infeed station adjacent the path of travel, said second infeed station including a second feed magazine for holding accumulated work products therein and a second comb plate spaced therefrom for supporting work products thereon; and a second means for moving a second predetermined number of work products from said second infeed station through a second arcuate path and into one of the flights of the feed conveyor and along the path of travel in timed relationship with the movement of the feed conveyor at a speed and direction substantially the same as the speed and direction of the feed conveyor along the path of travel.

25. The rotary motion feeder of claim 24, wherein said first means for moving and said second means for moving each comprises:

a framework;

a planetary feeder assembly supported for rotation on said framework; and drive means for rotating said feeder assembly in timed relationship with the movement of the feed conveyor.

26. The rotary motion feeder of claim 25, said planetary feeder assembly comprising:

a generally vertical and elongate central shaft mounted on said framework;

a generally horizontal carrier assembly formed about said central axis, said carrier assembly being rotated about said central axis by said drive means;

a sun gear mounted on said central shaft;

a plurality of idler gears supported on said carrier assembly, said idler gears being spaced equally apart from one another radially about said central axis, each of said idler gears being operatively engaged with said sun gear;

a plurality of generally vertical and elongate planetary shafts supported on said carrier assembly and having an end extending away from said carrier assembly, said planetary shafts being spaced equally apart from one another radially about said central axis, each said planetary shaft being parallel to said central shaft and having a planetary gear operatively engaged with one each of said idler gears; and a feed paddle mounted on said extended end of each said planetary shaft, each said feed paddle being constructed and arranged to pass through said first and said second comb plates, respectively.

27. The rotary motion feeder of claim 26, each said feed paddle comprising a generally horizontal base plate, a spaced series of aligned and generally vertical stripping fingers formed along a leading edge of said base plate, and a generally vertical pusher finger spaced with respect to said stripping fingers, said stripping fingers and said pusher finger forming a generally open pocket sized and shaped to engage said first and said second predetermined numbers of work products supported on said first and said second comb plates, respectively.

28. The rotary motion feeder of claim 27, wherein each said feed paddle assembly is constructed and arranged to move said first and said second predetermined numbers of work products along and off of the teeth of said first and said second comb plates, respectively, onto and across the dead plate of the packaging machine and into the flights of the feed conveyor.

29. The rotary motion feeder of claim 28, wherein said base plates of said feed paddle extend over the dead plate toward the path of travel as said feed paddles are moved through said first and said second arcuate paths, respectively.

30. The rotary motion feeder of claim 27, each of said feed paddles being aligned in a parallel orientation with the path of travel and remaining in said parallel orientation along the path of travel as said planetary feeder assembly rotates about said central shaft.

31. The rotary motion feeder of claim 27, wherein said pusher finger first engages work products supported on said comb plates once the feed paddle has been moved through an arcuate path of approximately 30 degrees along said first and said second arcuate paths, respectively, in the direction of the path of travel.

32. The rotary motion feeder of claim 25, wherein each said planetary feeder assembly is constructed and arranged to accelerate said first and said second predetermined numbers of work products to approximately the speed of the feed conveyor along the path of travel.

33. The rotary motion feeder of claim 24, wherein said first means for moving and said second means for moving are constructed and arranged to alternately place said first and said second predetermined numbers of work products into the flights of the feed conveyor, respectively, for forming a series of alternating first and second predetermined numbers of work products in the flights of the feed conveyor.

34. The rotary motion feeder of claim 24, wherein said first means for moving is constructed and arranged to place said first predetermined number of work products into the flights of the feed conveyor, and said second means for moving is constructed and arranged to place said second predetermined numbers of work products on top of said first predetermined work products in the flights of the feed conveyor.

35. The rotary motion feeder of claim 23, wherein said first comb plate and said second comb plate each has a spaced series of elongate and generally horizontal teeth for holding work products thereon, said teeth of said first comb plate extending along at least a portion of said first arcuate path in the direction of the path of travel, and said teeth of said second comb plate extending along at least a portion of said second arcuate path in the direction of the path of travel.

36. The rotary motion feeder of claim 35, wherein each said comb plate extends through an arc of approximately 70 degrees along said first and said second arcuate paths, respectively, in the direction of the path of travel.

* * * * *